US012668408B2

(12) United States Patent
Holley, Jr.

(10) Patent No.: US 12,668,408 B2
(45) Date of Patent: Jun. 30, 2026

(54) CARTON FOR CONTAINERS

(71) Applicant: Graphic Packaging International, LLC, Atlanta, GA (US)

(72) Inventor: John Murdick Holley, Jr., Lawrenceville, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 81 days.

(21) Appl. No.: 18/386,277

(22) Filed: Nov. 2, 2023

(65) Prior Publication Data

US 2024/0150100 A1 May 9, 2024

Related U.S. Application Data

(60) Provisional application No. 63/422,603, filed on Nov. 4, 2022.

(51) Int. Cl.
*B65D 71/36* (2006.01)

(52) U.S. Cl.
CPC ..... *B65D 71/36* (2013.01); *B65D 2571/0045* (2013.01); *B65D 2571/00524* (2013.01);
(Continued)

(58) Field of Classification Search
CPC ..... B65D 71/36; B65D 2571/0045; B65D 2571/00524; B65D 2571/00537;
(Continued)

(56) References Cited

U.S. PATENT DOCUMENTS 3,677,458 A 7/1972 Gosling
4,222,485 A 9/1980 Focke
(Continued)

FOREIGN PATENT DOCUMENTS

AU 2014268358 B2 11/2015
AU 2016259019 B2 11/2016
(Continued)

OTHER PUBLICATIONS

How to open a 12 pack of soda.—YouTube. Date posted: Mar. 9, 2020. Site visited: Jan. 28, 2025. Available Online: https://www.youtube.com/watch?v=_7rcmZgU2sU (Year: 2020).
(Continued)

*Primary Examiner* — Christopher R Demeree
(74) *Attorney, Agent, or Firm* — Andrew N. Claerbout; FisherBroyles, LLP

(57) ABSTRACT

A carton for holding a plurality of containers includes a plurality of panels extending at least partially around an interior of the carton, the plurality of panels including a top panel, a bottom panel, and at least one side panel, a plurality of end flaps foldably connected to a respective panel of the plurality of panels and overlapped to form at least one closed end of the carton, and handle features for facilitating lifting and/or carrying of the carton, the handle features including at least one handle opening in the top panel, a first line of weakening in the top panel extending from the at least one handle opening, and a second line of weakening in the top panel, the first line of weakening and the second line of weakening offset from one another.

32 Claims, 5 Drawing Sheets

(52) U.S. Cl.
CPC ..... *B65D 2571/00537* (2013.01); *B65D 2571/0066* (2013.01)

(58) Field of Classification Search
CPC .. B65D 2571/0066; B65D 2571/00141; B65D 2571/00469; B65D 2571/00543; B65D 2571/00549; B65D 2571/00728; B65D 2571/00574; B65D 2571/00462; B65D 5/46
USPC .... 229/117.13, 117.12, 117.14, 920, 117.15, 229/117.22, 930; 206/427, 428, 141
See application file for complete search history.

(56) References Cited

U.S. PATENT DOCUMENTS

| | | | | |
|---|---|---|---|---|
| 5,072,876 | A | 12/1991 | Wilson | |
| 5,108,030 | A | 4/1992 | Schuster et al. | |
| 5,119,985 | A | 6/1992 | Dawson et al. | |
| 5,234,102 | A | 8/1993 | Schuster et al. | |
| 5,297,725 | A | 3/1994 | Sutherland | |
| 5,307,986 | A | 5/1994 | Schuster | |
| D350,480 | S | 9/1994 | Sutherland | |
| 5,381,891 | A | 1/1995 | Harris | |
| 5,427,241 | A | 6/1995 | Sutherland | |
| 5,458,234 | A | 10/1995 | Harris | |
| 5,480,091 | A | 1/1996 | Stout | |
| 5,485,915 | A | 1/1996 | Harris | |
| 5,524,756 | A | 6/1996 | Sutherland | |
| 5,551,556 | A | 9/1996 | Sutherland | |
| 5,639,017 | A | 6/1997 | Fogle | |
| 5,647,483 | A | 7/1997 | Harris | |
| 5,669,500 | A | 9/1997 | Sutherland | |
| 5,704,470 | A | 1/1998 | Sutherland | |
| 5,794,778 | A | 8/1998 | Harris | |
| 5,873,515 | A | 2/1999 | Dunn et al. | |
| 5,915,546 | A | 6/1999 | Harrelson | |
| 5,992,733 | A | 11/1999 | Gomes | |
| 6,021,899 | A | 2/2000 | Sutherland | |
| 6,065,590 | A | 5/2000 | Spivey, Sr. | |
| 6,105,854 | A | 8/2000 | Spivey et al. | |
| 6,109,438 | A | 8/2000 | Sutherland | |
| 6,129,266 | A * | 10/2000 | Oliff | B65D 71/36 229/117.12 |
| 6,176,419 | B1 | 1/2001 | Holley, Jr. | |
| 6,227,367 | B1 | 5/2001 | Harrelson et al. | |
| 6,250,542 | B1 | 6/2001 | Negelen | |
| 6,260,755 | B1 | 7/2001 | Bates et al. | |
| 6,273,330 | B1 * | 8/2001 | Oliff | B65D 71/30 229/117.12 |
| 6,484,903 | B2 | 11/2002 | Spivey et al. | |
| D496,270 | S | 9/2004 | Baxter | |
| 6,848,573 | B2 | 2/2005 | Gould et al. | |
| 6,926,193 | B2 | 8/2005 | Smalley | |
| 6,968,992 | B2 | 11/2005 | Schuster | |
| 7,048,817 | B1 | 5/2006 | Hammond | |
| 7,073,665 | B2 | 7/2006 | Auclair | |
| 7,273,161 | B2 | 9/2007 | Fogle et al. | |
| 7,427,010 | B2 | 9/2008 | Sutherland | |
| 7,743,968 | B2 | 6/2010 | Theelen | |
| 7,793,779 | B2 | 9/2010 | Spivey, Sr. et al. | |
| 8,348,142 | B2 | 1/2013 | Smalley | |
| 8,936,149 | B2 | 1/2015 | Smalley | |
| 9,010,620 | B2 | 4/2015 | Sutherland et al. | |
| 9,126,716 | B2 | 9/2015 | Kohler et al. | |
| 10,040,596 | B2 * | 8/2018 | Leite | B65D 71/36 |
| D854,412 | S | 7/2019 | Smalley | |
| 10,384,846 | B2 | 8/2019 | Bates et al. | |
| D867,900 | S | 11/2019 | Thompson et al. | |
| 11,254,465 | B2 * | 2/2022 | Ford | B65D 5/427 |
| D947,022 | S | 3/2022 | Bellamah | |
| 11,305,924 | B2 | 4/2022 | Smalley | |
| 2004/0099558 | A1 | 5/2004 | Oliff | |
| 2005/0056658 | A1 | 3/2005 | Spivey | |
| 2005/0167478 | A1 | 8/2005 | Holley, Jr. | |
| 2006/0169755 | A1 | 8/2006 | Spivey, Sr. | |
| 2007/0017962 | A1 | 1/2007 | Russ | |
| 2007/0039846 | A1 | 2/2007 | Spivey, Sr. | |
| 2007/0051781 | A1 | 3/2007 | Holley, Jr. | |
| 2007/0080083 | A1 | 4/2007 | Holley | |
| 2007/0181658 | A1 | 8/2007 | Sutherland | |
| 2007/0295789 | A1 | 12/2007 | Ho Fung | |
| 2009/0236408 | A1 | 9/2009 | Spivey, Sr. et al. | |
| 2011/0233091 | A1 | 9/2011 | Block | |
| 2014/0151444 | A1 * | 6/2014 | Fogle | B65D 5/46192 229/117.15 |
| 2017/0174388 | A1 | 6/2017 | Leite | |
| 2017/0233131 | A1 | 8/2017 | Nielsen et al. | |
| 2017/0233132 | A1 | 8/2017 | Smalley et al. | |
| 2018/0044086 | A1 | 2/2018 | Patwardhan | |
| 2021/0362926 | A1 * | 11/2021 | Gonzalez Manzano | B65D 71/36 |
| 2024/0150100 | A1 | 5/2024 | Holley, Jr. | |

FOREIGN PATENT DOCUMENTS

| | | | |
|---|---|---|---|
| CA | 2 246 020 | A | 2/2000 |
| EM | 002294371-0001 | | 9/2013 |
| EP | 1 381 545 | B1 | 10/2005 |
| WO | WO 2001/066434 | A1 | 9/2001 |
| WO | WO 2012/054326 | A2 | 4/2012 |
| WO | WO 2019/136338 | A1 | 7/2019 |

OTHER PUBLICATIONS

Custom Printed Beverage Packaging Boxes Wholesale. Date posted: Nov. 5, 2024. Site visited: Jan. 28, 2025. Available Online: https://custompackagingpro.com/product/beverage-boxes (Year: 2024).
International Search Report and Written Opinion for PCT/US2023/036640 dated Mar. 4, 2024.

* cited by examiner

CARTON FOR CONTAINERS

CROSS-REFERENCE TO RELATED APPLICATION

This application claims the benefit of U.S. Provisional Patent Application No. 63/422,603, filed on Nov. 4, 2022.

INCORPORATION BY REFERENCE

The disclosures of each of U.S. Provisional Patent Application No. 63/422,603, filed on Nov. 4, 2022, and U.S. Design patent application Ser. No. 29/906,117, filed on Oct. 31, 2023, are hereby incorporated by reference for all purposes as if set forth in their entireties.

BACKGROUND OF THE DISCLOSURE

The present disclosure generally relates to cartons for holding beverage containers or other types of articles. More specifically, the present disclosure relates to cartons configured with handle features that facilitate even stress distribution across portions of the carton when carried by a user.

SUMMARY OF THE DISCLOSURE

According to one aspect, the disclosure is generally directed to a carton for holding a plurality of containers, the carton comprising a plurality of panels extending at least partially around an interior of the carton, the plurality of panels comprising a top panel, a bottom panel, and at least one side panel, a plurality of end flaps foldably connected to a respective panel of the plurality of panels and overlapped to form at least one closed end of the carton, and handle features for facilitating lifting and/or carrying of the carton, the handle features comprising at least one handle opening in the top panel, a first line of weakening in the top panel extending from the at least one handle opening, and a second line of weakening in the top panel, the first line of weakening and the second line of weakening offset from one another.

According to another aspect, the disclosure is generally directed to a blank for forming a carton for holding a plurality of containers, the blank comprising a plurality of panels for extending at least partially around an interior of the carton formed from the blank, the plurality of panels comprising a top panel, a bottom panel, and at least one side panel, a plurality of end flaps foldably connected to a respective panel of the plurality of panels and for being overlapped to form at least one closed end of the carton formed from the blank, and handle features for facilitating lifting and/or carrying of the carton formed from the blank, the handle features comprising at least one handle opening in the top panel, a first line of weakening in the top panel extending from the at least one handle opening, and a second line of weakening in the top panel, the first line of weakening and the second line of weakening offset from one another.

According to another aspect, the disclosure is generally directed to a method of forming a carton for holding a plurality of containers, the method comprising obtaining a blank comprising a plurality of panels comprising a top panel, a bottom panel, and at least one side panel, a plurality of end flaps foldably connected to a respective panel of the plurality of panels, and handle features comprising at least one handle opening in the top panel, a first line of weakening in the top panel extending from the at least one handle opening, and a second line of weakening in the top panel, the first line of weakening and the second line of weakening offset from one another. The method further comprises positioning the plurality of panels extending at least partially around an interior of the carton, overlapping the plurality of end flaps to form at least one closed end of the carton, and positioning the handle features for facilitating lifting and/or carrying of the carton.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION

The present disclosure generally relates to cartons that contain articles, for example, containers such as bottles, cans, etc. The articles can be used, for example, for packaging food and beverage products. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., aluminum cans or glass beverage bottles) as disposed within the carton embodiments. In this specification, the terms "inner," "outer," "lower," "bottom," "upper," and "top" indicate orientations determined in relation to fully erected and upright cartons.

As described herein, cartons may be formed by multiple overlapping panels and/or end flaps. Such panels and/or end flaps may be designated in relative terms to one another, e.g., "first", "second", "third", etc., in sequential or non-sequential reference, without departing from the disclosure.

Figure 1:
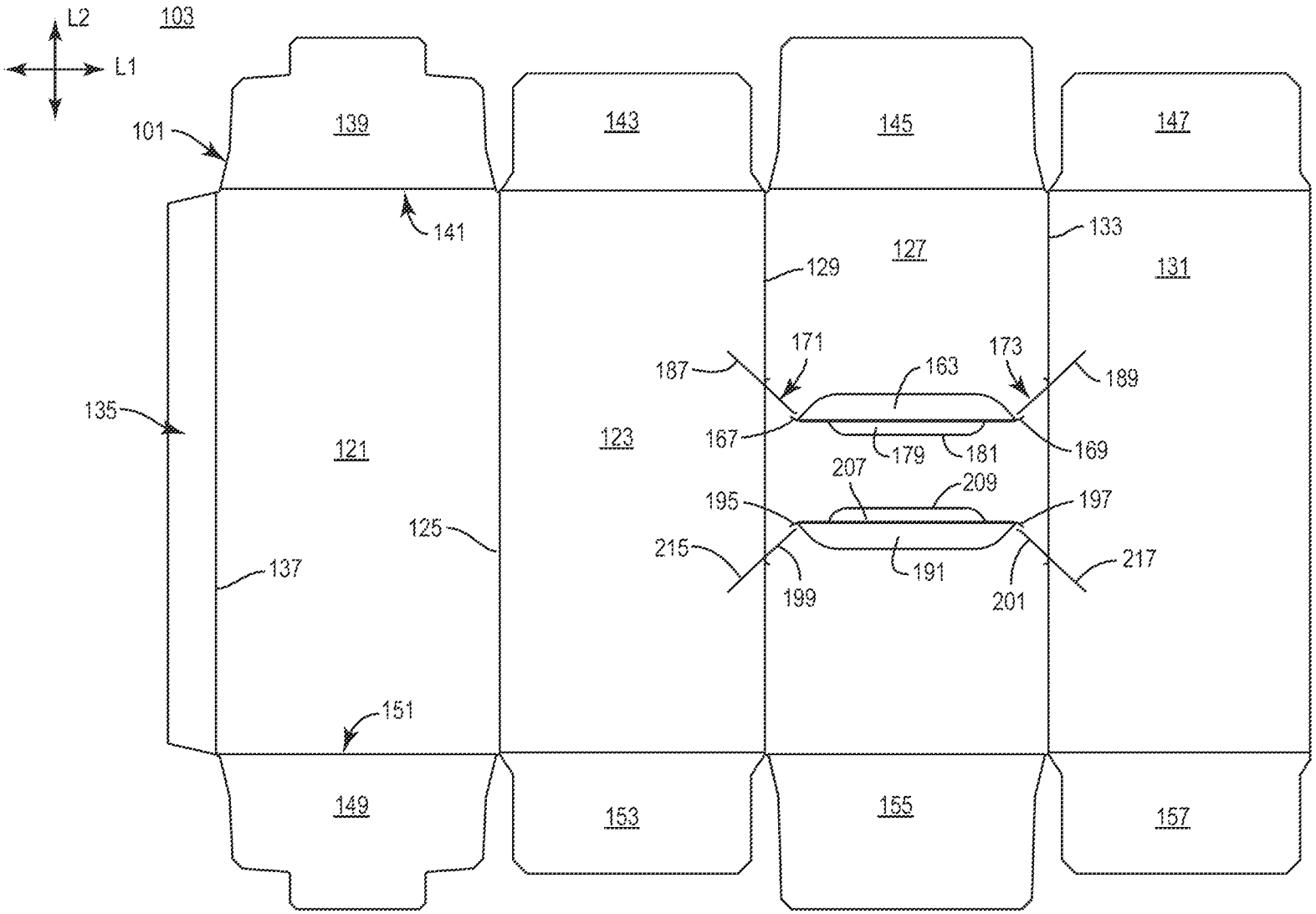
FIG. 1 is a schematic plan view of an exterior surface of a blank for forming a carton according to an exemplary embodiment of the disclosure.
Figure 1A:
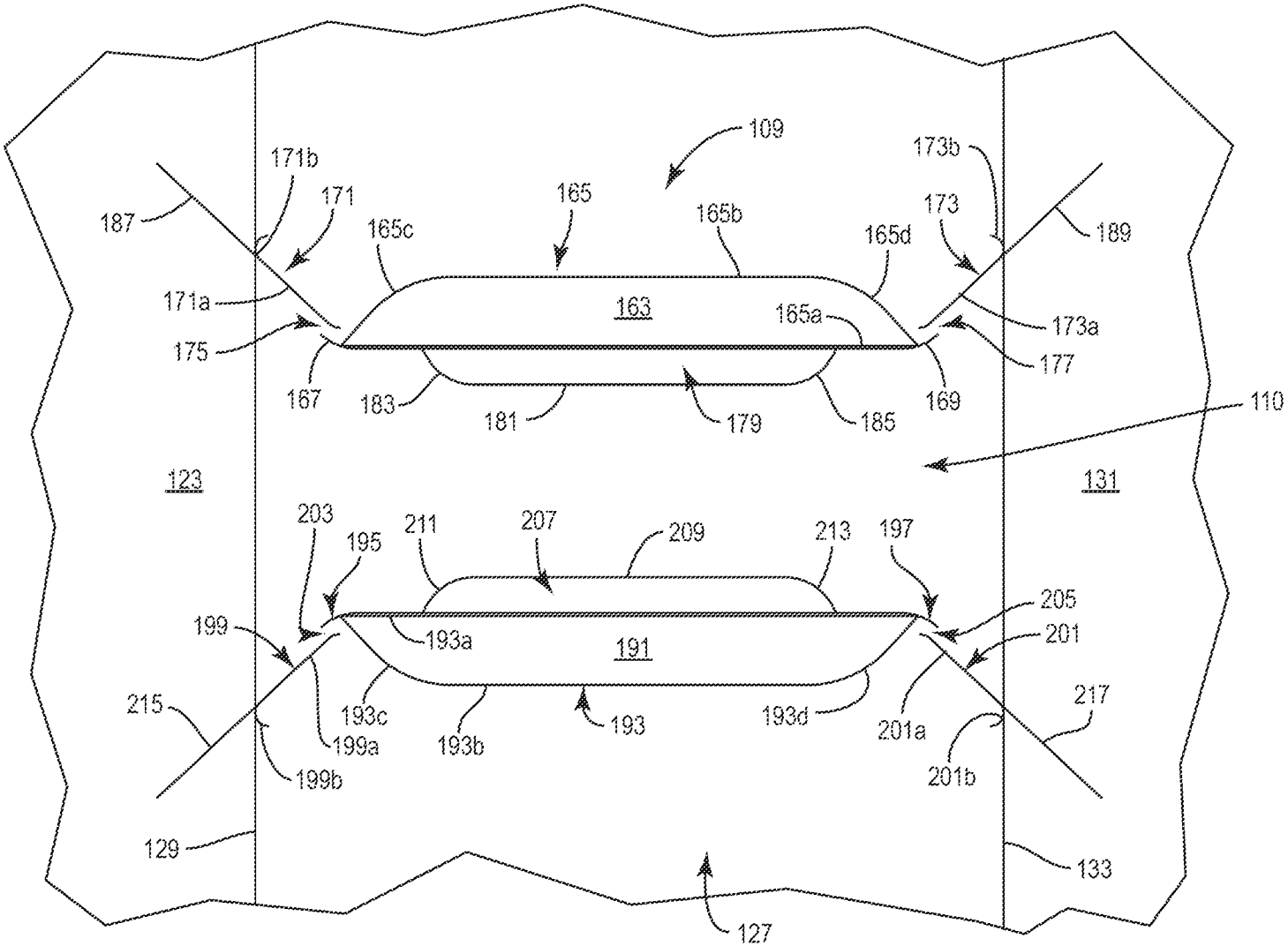
FIG. 1A is an enlarged view of a portion of the blank of FIG. 1.

FIG. 1 shows a plan view of the exterior surface 101 of a blank, generally indicated at 103, that can be obtained to form a carton 105 (FIG. 2) according to one exemplary embodiment of the disclosure. FIG. 1A is an enlarged view of a portion of the blank 103.

Figure 2:
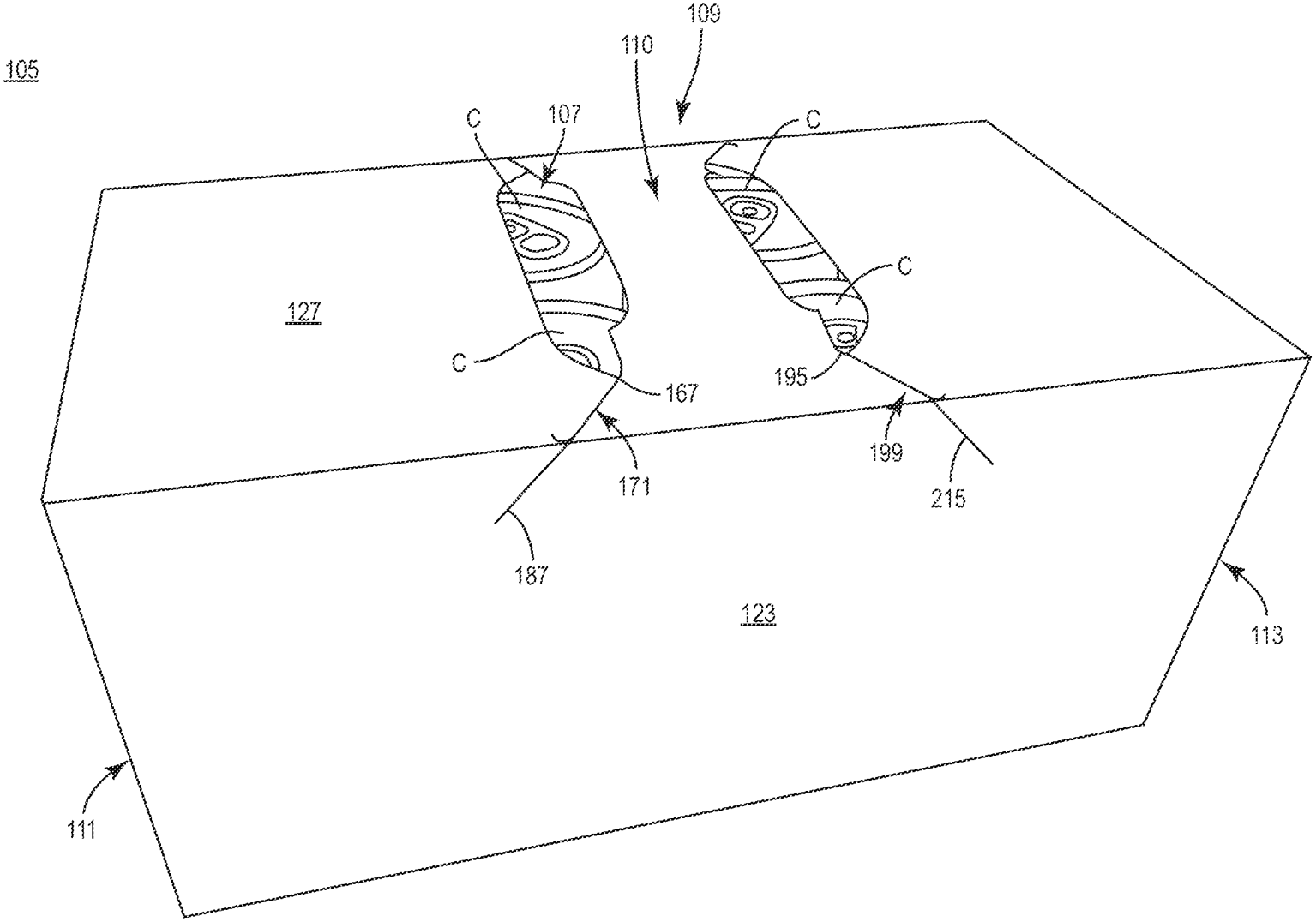
FIG. 2 is a perspective view of a carton formed from the blank of FIG. 1 according to an exemplary embodiment of the disclosure.

As described herein, the carton 105 can be used to house a plurality of articles in an interior 107 thereof such as containers in the form of beverage containers C (FIG. 2)

having a lower base portion, a top portion generally comprising a neck that tapers inwardly from the lower base portion, a flange portion at the top of the neck portion that extends radially outward from the neck portion, and a top surface below the flange portion that includes a pull-tab.

As described herein, the carton 105 is provided with a handle 109 having relief features for distributing forces associated with lifting and/or carrying the carton 105. Such forces can include the weight of the containers C in the interior 107 of the carton 105.

Still referring to FIG. 1, the blank 103 has a longitudinal axis L1 and a lateral axis L2. The blank 103 can include a plurality of panels for extending at least partially around an interior 107 of the carton 105 within which the containers C or articles can be held.

As shown, the panels can include a bottom panel 121 foldably connected to a first side panel 123 at a lateral fold line 125, a top panel 127 foldably connected to the first side panel 123 at a lateral fold line 129, and a second side panel 131 foldably connected to the top panel 127 at a lateral fold line 133.

The blank 103 and carton 105 formed therefrom can also include a plurality of end flaps foldably connected to a respective panel of the plurality of panels, and which can include a glue flap or attachment flap 135 foldably connected to the bottom panel 121 at a lateral fold line 137.

The plurality of end flaps can also include an end flap 139 foldably connected to the bottom panel 121 at a respective portion of a longitudinal fold line 141, an end flap 143 foldably connected to the first side panel 123 at a respective portion of the fold line 141, an end flap 145 foldably connected to the top panel 127 at a respective portion of the fold line 141, and an end flap 147 foldably connected to the second side panel 131 at a respective portion of the fold line 131. The end flaps 139, 143, 145, 147 can be a first plurality of end flaps extending along a marginal portion of the blank 103 and for being overlapped to form a first closed end 111 of the carton 105.

The plurality of end flaps can also include an end flap 149 foldably connected to the bottom panel 121 at a respective portion of a longitudinal fold line 151, an end flap 153 foldably connected to the first side panel 123 at a respective portion of the fold line 151, an end flap 155 foldably connected to the top panel 127 at a respective portion of the fold line 151, and an end flap 157 foldably connected to the second side panel 131. The end flaps 149, 153, 155, 157 can be a second plurality of end flaps extending along a marginal portion of the blank 103 and for being overlapped to form a second closed end 113 of the carton 105.

The blank 103 and carton 105 formed therefrom can also include handle features for facilitating lifting and/or carrying of the carton 105 formed from the blank 103. As described further herein, the handle features are configured and arranged to evenly activate to distribute stresses across the carton 105.

As shown best in FIG. 1A, the handle features can include a first handle opening 163 (broadly, "second handle opening") defined by a cut 165 in the top panel 127 that includes a first generally longitudinal segment 165*a*, a second generally longitudinal segment 165*b*, and respective generally curved segments 165*c*, 165*d* extending from a respective endpoint of the segment 165*a* to a respective endpoint of the segment 165*b*.

Generally curved lines of weakening 167, 169 (broadly, respective "first line of weakening" or "third line of weakening" or "fifth line of weakening" or "seventh line of weakening") extend away from the endpoints/points of intersection of the respective segment 165*a* and segments 165*c*, 165*d* of the cut 165. As also shown, generally elongate J-shaped lines of weakening 171, 173 (broadly, respective "second line of weakening" or "fourth line of weakening" or "sixth line of weakening" or "eighth line of weakening") can extend obliquely away from respective endpoints of the lines of weakening 167, 169, although respective portions thereof can be at least partially coextensive. The lines of weakening 171, 173 can include a respective generally oblique segment 171*a*, 173*a* and a respective generally curved segment 171*b*, 173*b* extending away therefrom.

In the illustrated embodiment, the endpoints of the lines of weakening 171, 173 at the respective oblique segments 171*a*, 173*a* thereof can be spaced apart from the endpoints of the respective lines of weakening 167, 169 to at least partially define respective by-pass portions or bridging portions 175, 177 (broadly, respective "first bridging portion" or "second bridging portion" or "third bridging portion" or "fourth bridging portion") that are portions of the top panel 127 therebetween. In some embodiments, endpoints of the lines of weakening 167, 171 and/or endpoints of the lines of weakening 169, 173 can be spaced apart between about 0.04 inches and about 0.06 inches. In some embodiments, endpoints of the lines of weakening 167, 171 and/or endpoints of the lines of weakening 169, 173 can be spaced apart between about 0.052 inches and about 0.054 inches.

A handle reinforcement flap 179 can be foldably connected to the top panel 127 at a longitudinal fold line 181 having endpoints that intersect respective curved cuts 183, 185 that extend to the handle opening 163.

In addition, respective oblique creases or oblique lines of weakening 187, 189 can extend from the respective fold lines 129, 133 and can intersect portions of the segments 171*b*, 173*b* of the lines of weakening 171, 173.

Similarly, the handle features can include a second handle opening 191 (broadly, "first handle opening") defined by a cut 193 in the top panel 127 that includes a first generally longitudinal segment 193*a*, a second generally longitudinal segment 193*b*, and respective generally curved segments 193*c*, 193*d* extending from a respective endpoint of the segment 193*a* to a respective endpoint of the segment 193*b*.

Generally curved lines of weakening 195, 197 (broadly, respective "first line of weakening" or "third line of weakening" or "fifth line of weakening" or "seventh line of weakening") extend away from the endpoints/points of intersection of the respective segment 193*a* and segments 193*c*, 193*d* of the cut 193. As also shown, generally elongate J-shaped lines of weakening 199, 201 (broadly, respective "second line of weakening" or "fourth line of weakening" or "sixth line of weakening" or "eighth line of weakening") can extend away from respective endpoints of the lines of weakening 195, 197, though respective portions thereof can be at least partially coextensive. The lines of weakening 199, 201 can include a respective generally oblique segment 199*a*, 201*a* and a respective generally curved segment 199*b*, 201*b* extending away therefrom.

In the illustrated embodiment, the endpoints of the lines of weakening 199, 201 at the respective oblique segments 199*a*, 201*a* thereof can be spaced apart from the endpoints of the respective lines of weakening 195, 197 to define respective by-pass portions or bridging portions 203, 205 (broadly, respective "first bridging portion" or "second bridging portion" or "third bridging portion" or "fourth bridging portion") that are portions of the top panel 127 therebetween. In some embodiments, endpoints of the lines of weakening 195, 199 and/or endpoints of the lines of weakening 197, 201 can be spaced apart between about 0.04 inches and about 0.06 inches. In some embodiments, endpoints of the lines of weakening 167, 171 and/or endpoints of the lines of weakening 169, 173 can be spaced apart between about 0.052 inches and about 0.054 inches.

A handle reinforcement flap 207 can be foldably connected to the top panel 127 at a longitudinal fold line 209 having endpoints that intersect respective curved cuts 211, 213 that extend to the handle opening 191.

In addition, respective oblique creases or oblique lines of weakening 215, 217 can extend from the respective fold lines 129, 133 and can intersect portions of the segments 199*b*, 201*b* of the lines of weakening 199, 201.

In some embodiments, one or more of the following arrangements can be considered a line of weakening having one or more interruptions therealong: the lines of weakening 167, 171 and the bridging portion 175, the lines of weakening 169, 173, and the bridging portion 177; the lines of weakening 195, 199 and bridging portion 203; and the lines of weakening 197, 201 and bridging portion 205.

The aforementioned arrangement of handle features is such that a portion of the top panel 127 between the respective lines of weakening, handle openings, and handle reinforcement flaps can form a handle strap 110 of the handle 109. In some embodiments, the handle reinforcement flaps 137, 207 can be foldably connected to the handle strap 110 adjacent a respective handle opening 163, 191.

The blank 103 and carton 105 formed therefrom can be provided with a different arrangement of handle features without departing from the disclosure.

Turning to FIG. 2, in some embodiments, the carton 105 can be formed from the blank 103 by folding the plurality of panels 121, 123, 127, 131 at the respective fold lines 125, 129, 133 such that the top panel 127 and bottom panel 121 are positioned in generally spaced and parallel relation, with each of the side panels 123, 131 extending from the top panel 127 to the bottom panel 121 and in generally perpendicular relation thereto.

Such an arrangement can be an open sleeve configuration of the carton 105, in which the plurality of panels extend at least partially around the interior 107 of the carton 105 such that one or more containers C can be received therein.

The end flaps 139, 143, 145, 147 can be folded at respective portions of the fold line 141 and overlapped so as to form the first closed end 111 of the carton 105, and the end flaps 149, 153, 155, 157 can be folded at respective portions of the fold line 151 and at least partially overlapped so as to form the second closed end 113 of the carton 105.

The aforementioned arrangement of the carton 105 can be at least partially maintained with one or more applications of an adhesive such as glue. In some embodiments, glue can be applied to one or more one or more portions of one or more of the attachment flap 135, the side panel 131, the end flap 139, the end flap 143, the end flap 147, the end flap 149, the end flap 153, and the end flap 157.

Figure 3:
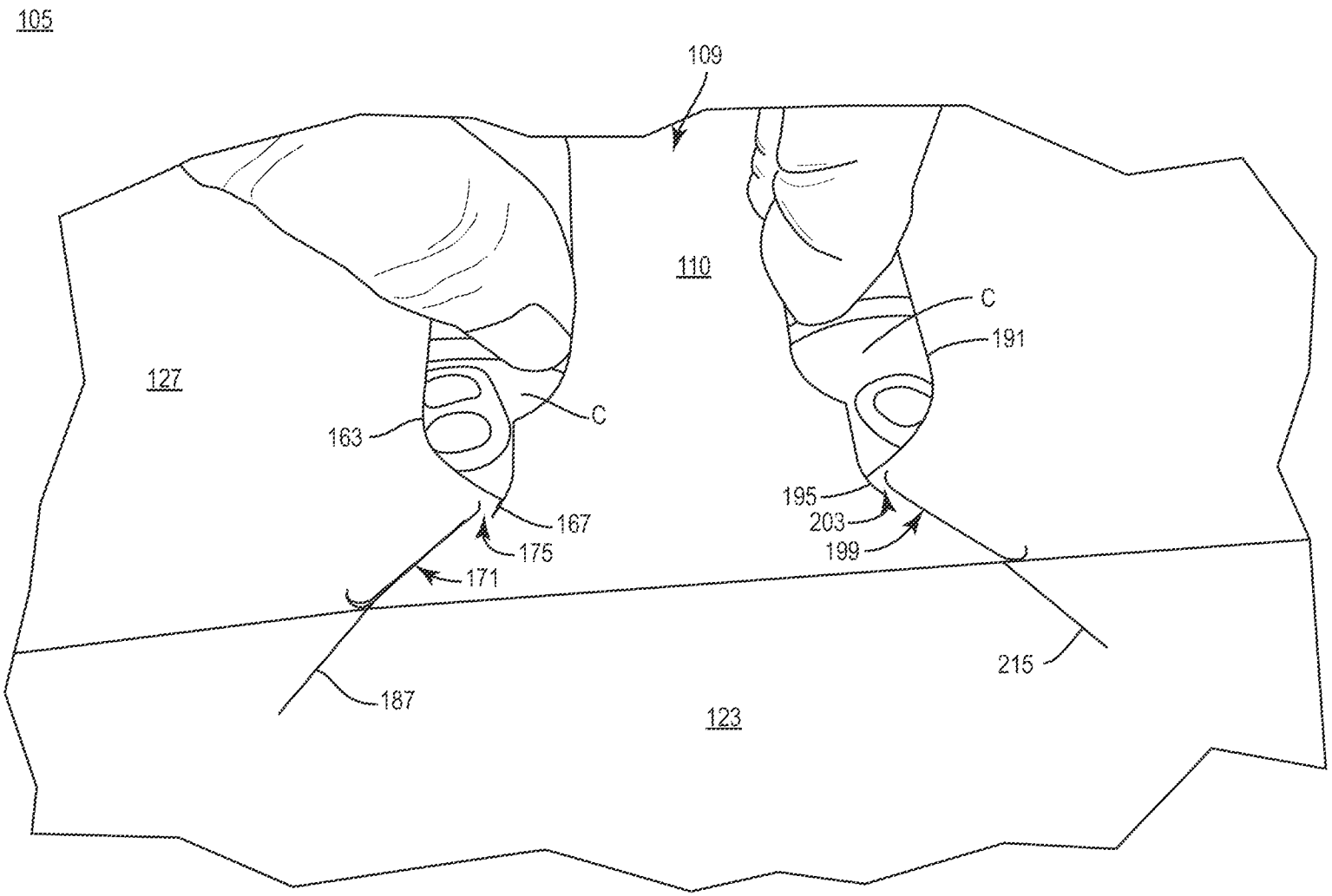
FIG. 3 is an enlarged perspective view of a portion of the carton of FIG. 2 being grasped by a user.
Figure 4:
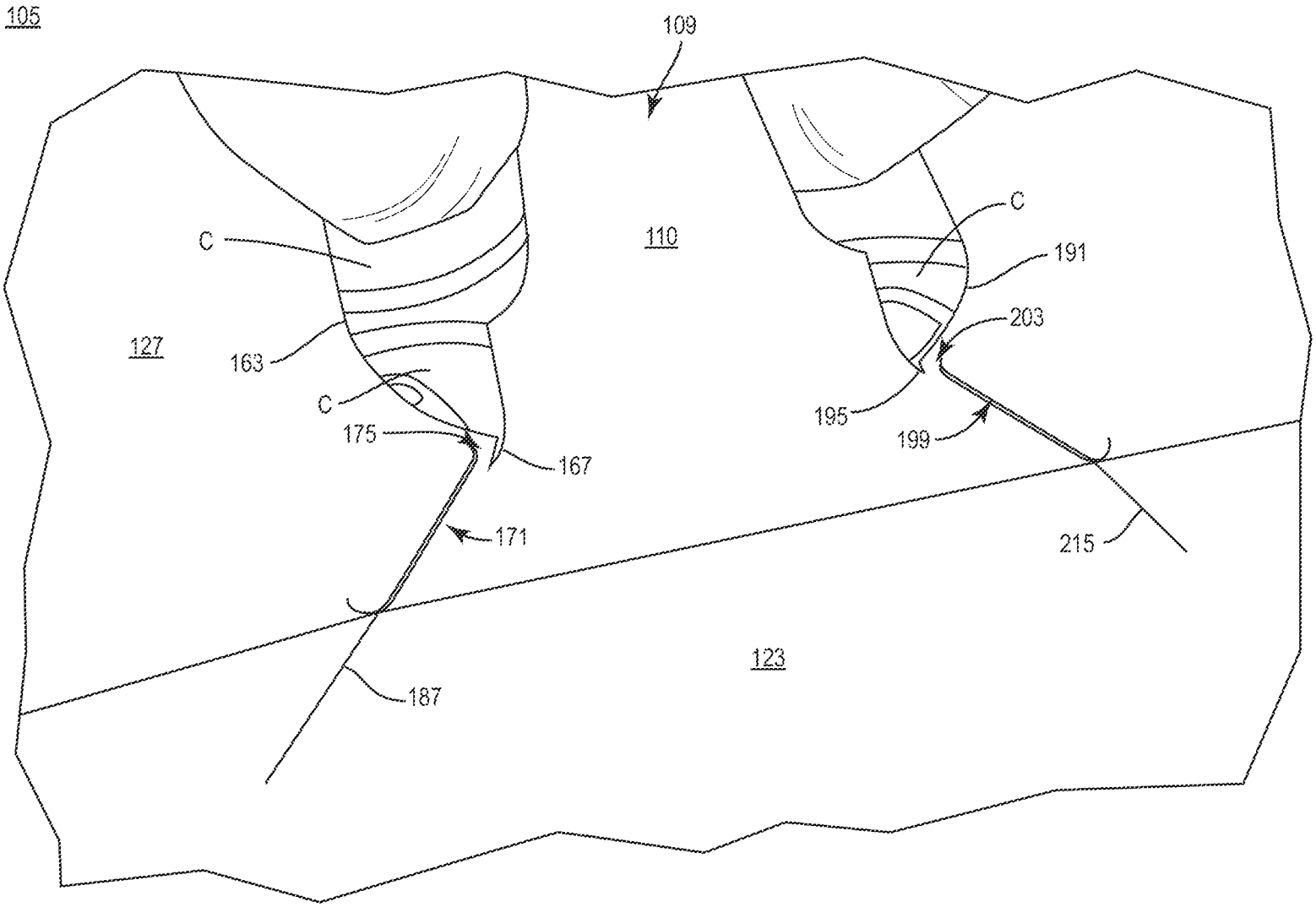
FIG. 4 is an enlarged perspective view of a portion of the carton of FIG. 2 being lifted by a user.

With additional reference to FIGS. 3 and 4, upon formation of the carton 105, in some embodiments, a user can grasp the handle 109. Engagement of the handle 109 can include at least partially inserting one or more of the user's fingers into a respective handle opening 163, 191 and curling his or her fingers about the handle strap 110.

Such engagement of the handle 109 can cause one or both of the handle reinforcement flaps 179, 207 to fold at the respective fold line 181, 209 to provide an extra layer of material between the user's hand and the handle strap 110.

Upon lifting of the carton 105 via the handle 109, the weight of the containers C in the interior 107 of the carton 105 can cause the handle strap 110 to at least partially separate from the remainder of the carton 105 via activation of the remainder of the handle features.

In some embodiments, the aforementioned activation of the handle features can include separation of the handle strap 110 from the remainder of the carton 105 at least at the lines of weakening 167, 169, 171, 173, 195, 197, 199, 201. In this regard, such handle activation is symmetrical across a plurality of directions emanating from the handle 109, e.g., four directions in the illustrated embodiment.

It will be understood that the handle strap 110 can remain attached to the remainder of the top panel 127 of the carton 105 at one or more of the bridging portions 175, 177, 203, 205, but that the failure, e.g., breaking, tearing, etc., of one or more of the bridging portions 175, 177, 203, 205 does not inhibit the aforementioned activation of each of the lines of weakening 167, 169, 171, 173, 195, 197, 199, 201.

Activation of the handle and/or carrying of the carton 105 can also include relative movement of one or more portions of the side panel 123 at the lines of weakening 187, 215 and/or relative movement of one or more portions of the side panel 131 at the lines of weakening 189, 217.

In this regard, the relative offset of the lines of weakening 167, 171 (to provide the bridging portion 175 therebetween), the relative offset of the lines of weakening 169, 173 (to provide the bridging portion 177 therebetween), the relative offset of the lines of weakening 195, 199 (to provide the bridging portion 203 therebetween), and the relative offset of the lines of weakening 197, 201 (to provide the bridging portion 205 therebetween) allows for uniform activation of handle features as compared to handle feature arrangements that lack the aforementioned offsets and bridging portions.

For example, nonuniform activation of handle features that the disclosed arrangement and configuration of handle features avoids can cause a user to hold and/or carry a carton in a lopsided or hesitant manner that can be detrimental to the user's form, e.g., by causing the user to quickly shift to compensate for the asymmetrical load, and/or to safe transport of such carton and its contents.

Any of the features of the various embodiments of the disclosure can be combined with, replaced by, or otherwise configured with other features of other embodiments of the disclosure without departing from the scope of this disclosure. Further, it is noted that the nesting arrangements and/or the features of the blanks and cartons of the various embodiments can be incorporated into a carton or blank having any carton style or panel configuration. The carton styles and panel configurations described above are included by way of example.

The blanks according to any of the embodiments of the present disclosure can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described herein. The blank can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding a plurality of containers, the carton comprising:

a plurality of panels extending at least partially around an interior of the carton, the plurality of panels comprising a top panel, a bottom panel, and at least one side panel foldably connected to the top panel at a fold line;

a plurality of end flaps foldably connected to a respective panel of the plurality of panels and overlapped to form at least one closed end of the carton; and handle features for facilitating lifting of the carton, the handle features comprising a first handle opening in the top panel, a second handle opening spaced apart from the first handle opening in the top panel, and a handle strap in the top panel between the first handle opening and the second handle opening, a first line of weakening in the top panel extending from the first handle opening to a first endpoint, and a second line of weakening in the top panel extending from a second endpoint to the fold line, the first line of weakening and the second line of weakening offset from one another, the first end endpoint of the first line of weakening being spaced apart from the second endpoint of the second line of weakening to at least partially define a bridging portion between the first endpoint and second endpoint, the first line of weakening extending from the first handle opening to the first endpoint in a direction generally oblique to the fold line, the second line of weakening extending obliquely from the second endpoint to the fold line, the first line of weakening and the second line of weakening being generally parallel.

2. The carton of claim 1, wherein the bridging portion is configured to facilitate symmetrical activation of the handle features when the carton is lifted and/or carried by a user.

3. The carton of claim 2, wherein the endpoint of the first line of weakening and the endpoint of the second line of weakening can be between about 0.04 inches and about 0.06 inches from one another.

4. The carton of claim 3, wherein the endpoint of the first line of weakening and the endpoint of the second line of weakening can be between about 0.052 inches and about 0.054 inches from one another.

5. The carton of claim 3, wherein the bridging portion comprises a portion of the top panel positioned between the first line of weakening and the second line of weakening.

6. The carton of claim 2, wherein the at least one side panel is a first side panel, the fold line is a first fold line, the plurality of panels comprise a second side panel foldably connected to the top panel at a second fold line, the handle features further comprise a third line of weakening in the top panel extending from the first handle opening to a third endpoint and a fourth line of weakening in the top panel extending from a fourth end point to the second fold line, the third line of weakening and the fourth line of weakening offset from one another.

7. The carton of claim 6, wherein the bridging portion is a first bridging portion, and the third endpoint of the third line of weakening is spaced apart from the fourth endpoint of the fourth line of weakening to at least partially define a second bridging portion therebetween, the third line of weakening extending from the first handle opening to the third endpoint in a direction generally oblique to the second fold line, the fourth line of weakening extending obliquely from the fourth endpoint to the second fold line, the third line of weakening and the fourth line of weakening being generally parallel in the top panel.

8. The carton of claim 7, wherein the handle features further comprise a fifth line of weakening in the top panel extending from the second handle opening to a fifth endpoint and a sixth line of weakening in the top panel extending from a sixth endpoint to the first fold line, the fifth line of weakening and the sixth line of weakening offset from one another to at least partially define a third bridging portion therebetween, the fifth line of weakening extending from the second handle opening to the fifth endpoint in a direction generally oblique to the first fold line, the sixth line of weakening extending obliquely from the sixth endpoint to the first fold line, the fifth line of weakening and the sixth line of weakening being generally parallel in the top panel.

9. The carton of claim 8, wherein the handle features further comprise a seventh line of weakening in the top panel extending from the second handle opening to a seventh endpoint and an eighth line of weakening in the top panel extending from an eighth endpoint to the second fold line, the seventh line of weakening and the eighth line of weakening offset from one another to at least partially define a fourth bridging portion therebetween, the seventh line of weakening extending from the second handle opening to the seventh endpoint in a direction generally oblique to the second fold line, the eight line of weakening extending obliquely from the eight endpoint to the second fold line, the seventh line of weakening and the eight line of weakening being generally parallel in the top panel.

10. The carton of claim 7, wherein at least one handle reinforcement flap is foldably connected to the handle strap and positioned adjacent a respective handle opening.

11. The carton of claim 5, wherein the portion of the top panel is an uninterrupted portion of the top panel free from boundary by a line of weakening extending between the first line of weakening and the second line of weakening.

12. A blank for forming a carton for holding a plurality of containers, the blank comprising:

a plurality of panels for extending at least partially around an interior of the carton formed from the blank, the plurality of panels comprising a top panel, a bottom panel, and at least one side panel foldably connected to the top panel at a fold line;

a plurality of end flaps foldably connected to a respective panel of the plurality of panels and for being overlapped to form at least one closed end of the carton formed from the blank; and handle features for facilitating lifting the carton formed from the blank, the handle features comprising a first handle opening in the top panel, a second handle opening spaced apart from the first handle opening in the top panel, and a handle strap in the top panel between the first handle opening and the second handle opening, a first line of weakening in the top panel extending from the first handle opening to a first endpoint, and a second line of weakening in the top panel extending from a second endpoint to the fold line, the first line of weakening and the second line of weakening offset from one another, the first end endpoint of the first line of weakening being spaced apart from the second endpoint of the second line of weakening to at least partially define a bridging portion between the first endpoint and second endpoint, the first line of weakening extending from the first handle opening to the first endpoint in a direction generally oblique to the fold line, the second line of weakening extending obliquely from the second endpoint to the fold line, the first line of weakening and the second line of weakening being generally parallel.

13. The blank of claim 12, wherein the bridging portion is configured to facilitate symmetrical activation of the handle features when the carton formed from the blank is lifted and/or carried by a user.

14. The blank of claim 13, wherein the endpoint of the first line of weakening and the endpoint of the second line of weakening can be between about 0.04 inches and about 0.06 inches from one another.

15. The blank of claim 14, wherein the endpoint of the first line of weakening and the endpoint of the second line of weakening can be between about 0.052 inches and about 0.054 inches from one another.

16. The blank of claim 13, wherein the bridging portion comprises a portion of the top panel positioned between the first line of weakening and the second line of weakening.

17. The blank of claim 16, wherein the portion of the top panel is an uninterrupted portion of the top panel free from boundary by a line of weakening extending between the first line of weakening and the second line of weakening.

18. The blank of claim 13, wherein the at least one side panel is a first side panel, the fold line is a first fold line, the plurality of panels comprise a second side panel foldably connected to the top panel at a second fold line, the handle features further comprise a third line of weakening in the top panel extending from the first handle opening to a third endpoint and a fourth line of weakening in the top panel extending from a fourth end point to the second fold line, the third line of weakening and the fourth line of weakening offset from one another.

19. The blank of claim 18, wherein the bridging portion is a first bridging portion, and the third endpoint of the third line of weakening is spaced apart from the fourth endpoint of the fourth line of weakening to at least partially define a second bridging portion therebetween, the third line of weakening extending from the first handle opening to the third endpoint in a direction generally oblique to the second fold line, the fourth line of weakening extending obliquely from the fourth endpoint to the second fold line, the third line of weakening and the fourth line of weakening being generally parallel in the top panel.

20. The blank of claim 2, wherein the handle features further comprise a fifth line of weakening in the top panel extending from the second handle opening to a fifth endpoint and a sixth line of weakening in the top panel extending from a sixth endpoint to the first fold line, the fifth line of weakening and the sixth line of weakening offset from one another to at least partially define a third bridging portion therebetween, the fifth line of weakening extending from the second handle opening to the fifth endpoint in a direction generally oblique to the first fold line, the sixth line of weakening extending obliquely from the sixth endpoint to the first fold line, the fifth line of weakening and the sixth line of weakening being generally parallel in the top panel.

21. The blank of claim 20, wherein the handle features further comprise a seventh line of weakening in the top panel extending from the second handle opening to a seventh endpoint and an eighth line of weakening in the top panel extending from an eighth endpoint to the second fold line, the seventh line of weakening and the eighth line of weakening offset from one another to at least partially define a fourth bridging portion therebetween, the seventh line of weakening extending from the second handle opening to the seventh endpoint in a direction generally oblique to the second fold line, the eight line of weakening extending obliquely from the eight endpoint to the second fold line, the seventh line of weakening and the eight line of weakening being generally parallel in the top panel.

22. The blank of claim 19, wherein at least one handle reinforcement flap is foldably connected to the handle strap and positioned adjacent a respective handle opening.

23. A method of forming a carton for holding a plurality of containers, the method comprising:

obtaining a blank comprising a plurality of panels comprising a top panel, a bottom panel, and at least one side panel foldably connected to the top panel at a fold line, a plurality of end flaps foldably connected to a respective panel of the plurality of panels, and handle features comprising a first handle opening in the top panel, a second handle opening spaced apart from the first handle opening in the top panel, and a handle strap in the top panel between the first handle opening and the second handle opening, a first line of weakening in the top panel extending from the first handle opening to a first end point, and a second line of weakening in the top panel extending from a second endpoint to the fold line, the first line of weakening and the second line of weakening offset from one another, the first end endpoint of the first line of weakening being spaced apart from the second endpoint of the second line of weakening to at least partially define a bridging portion between the first endpoint and second endpoint, the first line of weakening extending from the first handle opening to the first endpoint in a direction generally oblique to the fold line, the second line of weakening extending obliquely from the second endpoint to the fold line, the first line of weakening and the second line of weakening being generally parallel;

positioning the plurality of panels extending at least partially around an interior of the carton;

overlapping the plurality of end flaps to form at least one closed end of the carton; and positioning the handle features for facilitating lifting of the carton.

24. The method of claim 23, wherein the bridging portion is configured to facilitate symmetrical activation of the handle features when the carton is lifted and/or carried by a user.

25. The method of claim 24, wherein the endpoint of the first line of weakening and the endpoint of the second line of weakening can be between about 0.04 inches and about 0.06 inches from one another.

26. The method of claim 25, wherein the endpoint of the first line of weakening and the endpoint of the second line of weakening can be between about 0.052 inches and about 0.054 inches from one another.

27. The method of claim 8, wherein the bridging portion comprises a portion of the top panel positioned between the first line of weakening and the second line of weakening.

28. The method of claim 24, wherein the at least one side panel is a first side panel, the fold line is a first fold line, the plurality of panels comprise a second side panel foldably connected to the top panel at a second fold line, the handle features further comprise a third line of weakening in the top panel extending from the first handle opening to a third endpoint and a fourth line of weakening in the top panel extending from a fourth end point to the second fold line, the third line of weakening and the fourth line of weakening offset from one another.

29. The method of claim 28, wherein the bridging portion is a first bridging portion, and the third endpoint of the third line of weakening is spaced apart from the fourth endpoint of the fourth line of weakening to at least partially define a second bridging portion therebetween, the third line of weakening extending from the first handle opening to the third endpoint in a direction generally oblique to the second fold line, the fourth line of weakening extending obliquely from the fourth endpoint to the second fold line, the third line of weakening and the fourth line of weakening being generally parallel in the top panel.

30. The method of claim 29, wherein the handle features further comprise a fifth line of weakening in the top panel extending from the second handle opening to a fifth endpoint and a sixth line of weakening in the top panel extending from a sixth endpoint to the first fold line, the fifth line of weakening and the sixth line of weakening offset from one another to at least partially define a third bridging portion therebetween, the fifth line of weakening extending from the second handle opening to the fifth endpoint in a direction generally oblique to the first fold line, the sixth line of weakening extending obliquely from the sixth endpoint to the first fold line, the fifth line of weakening and the sixth line of weakening being generally parallel in the top panel.

31. The method of claim 30, wherein the handle features further comprise a seventh line of weakening in the top panel extending from the second handle opening to a seventh endpoint and an eighth line of weakening in the top panel extending from an eighth endpoint to the second fold line, the seventh line of weakening and the eighth line of weakening offset from one another to at least partially define a fourth bridging portion therebetween, the seventh line of weakening extending from the second handle opening to the seventh endpoint in a direction generally oblique to the second fold line, the eight line of weakening extending obliquely from the eight endpoint to the second fold line, the seventh line of weakening and the eight line of weakening being generally parallel in the top panel.

32. The method of claim 29, wherein at least one handle reinforcement flap is foldably connected to the handle strap and positioned adjacent a respective handle opening.

* * * * *